US005271555A

United States Patent [19]

Mayer

[11] Patent Number: 5,271,555

[45] Date of Patent: Dec. 21, 1993

[54] MOVABLE MAILBOX TRAY

[76] Inventor: Ellen N. Mayer, 746 Milford Mill Rd., Baltimore, Md. 21208

[21] Appl. No.: 961,666

[22] Filed: Oct. 16, 1992

[51] Int. Cl.[5] ..... B65D 91/00

[52] U.S. Cl. ..... 232/17; 232/29; 312/274

[58] Field of Search ..... 232/45, 1 C, 17, 29, 232/34, 35, 36, 43.2, 43.3, 43.4, 30, 31, 32; 312/274; 109/19, 47; 340/545, 569; D99/29

[56] References Cited

U.S. PATENT DOCUMENTS

| | | | |
|---|---|---|---|
| D. 192,164 | 2/1962 | Golden | D34/29 |
| 908,543 | 1/1909 | Brown | 232/34 |
| 2,796,310 | 6/1957 | Anderson | 312/274 |
| 3,981,436 | 9/1976 | Neal | 232/43.2 |
| 4,163,225 | 7/1979 | Engel | 340/569 |
| 4,600,143 | 7/1986 | Harlow, Jr. et al. | 232/17 |
| 4,651,135 | 3/1987 | Duhaime et al. | 340/569 |
| 4,860,949 | 8/1989 | Moore | 232/35 |
| 4,896,827 | 1/1990 | Economou | 232/1 C |
| 5,088,644 | 2/1992 | Scott | 232/30 |
| 5,137,212 | 8/1992 | Fiterman et al. | 232/43.2 |

FOREIGN PATENT DOCUMENTS

| | | | |
|---|---|---|---|
| 2431273 | 3/1980 | France | 232/35 |

*Primary Examiner*—Peter M. Cuomo
*Assistant Examiner*—Michael Milano
*Attorney, Agent, or Firm*—S. Michael Bender

[57] ABSTRACT

A new and improved movable mailbox tray is provided for a mailbox. The movable mailbox tray is in the form of a trolley that rides on a plurality of rollers for providing a rolling contact between the movable tray and the mailbox. The rollers permit the movable trolley to move easily into and out of a mailbox. The movable trolley can also include a fence for retaining mail on the tray. A kit for converting a conventional mailbox into one with a movable tray includes a movable trolley, a first spring for connecting the movable trolley to a hinged mailbox door, and an opposing second spring for connecting the opposite end of the trolley to a fixed wall of the mailbox. When the mailbox door is opened, the first spring will pull the trolley partially out from the interior of the mailbox. The opposing second spring will pull the trolley back into the interior of the mailbox when the door is closed. The kit can also include electrical components to provide an automatic, electric, mail-signalling device which automatically energizes a lamp providing a signal that the mailbox door has been opened.

5 Claims, 5 Drawing Sheets

FIG. 7
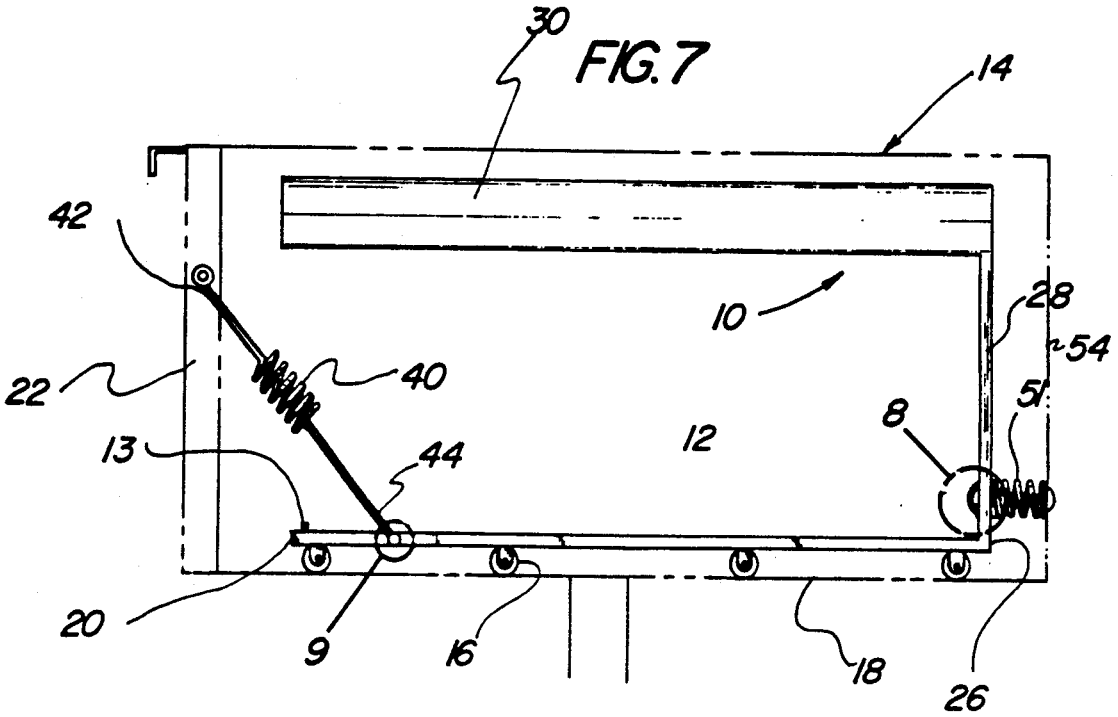
FIG. 8
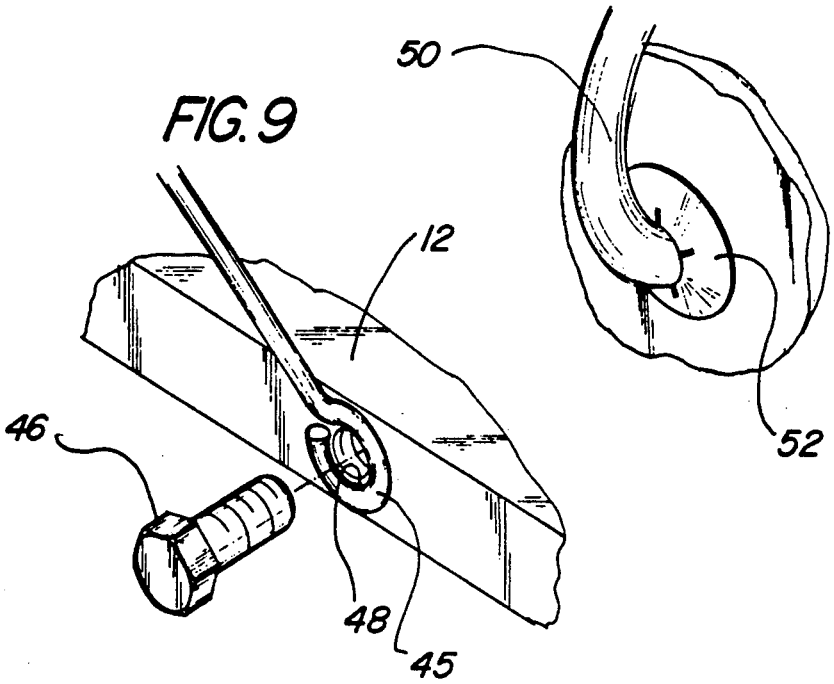
FIG. 9

MOVABLE MAILBOX TRAY

BACKGROUND OF THE INVENTION

1. Field of the Invention

The present invention relates generally to mailboxes, and more particularly, to movable mailbox trays that are inserted into a mailbox.

2. Description of the Prior Art

Mailboxes which include movable trays that are inserted into a mailbox are well known in the art. More specifically, the prior art discloses mailboxes having movable, insertable trays in the following U.S. Pat. Nos. 4,753,385 of Phipps et al which discloses an extendable mailbox tray that is made from a foldable sheet material that can be selectively folded to accommodate a particular mailbox; 4,896,827 of Economou which discloses a sliding mail tray that is tethered to the mailbox door and is pulled out when the door is opened; 4,932,587 of Robbins which discloses an insertable, slidable tray that is tilted to permit mail to slide downward and outward; and Des. 292,539 of Harlow et al which discloses a design for a slidable tray insert for a mailbox.

Thus, while the foregoing body of prior art indicates that is well known to use an insertable tray into a mailbox, there are problems associated with the prior art mailbox inserts. A key problem with conventional mailbox inserts is the manner of sliding action of the trays as they move out of and into the mailbox. The sliding action is impeded by a relatively high coefficient of sliding friction that is present between the material comprising the tray insert and the material comprising the interior floor of the mailbox. The frictional forces developed inhibit a smooth sliding action of the tray outward from the interior of the mailbox housing. Moreover, frictional force opposing a smooth sliding action is significantly dependent upon the weight of the mail present in the slidable tray. The frictional force opposing smooth sliding is proportional to the weight exerted on the sliding surfaces. A heavy weight of mail would cause a large amount of frictional sliding force to overcome. Overcoming such a frictional force could cause a jerking action to take place when the sliding tray is moved out from the interior of the mailbox housing.

Another aspect of prior art mailboxes disclosed in the prior art is a signal on the mailbox that mail has been deposited in the mailbox by the mailman. Conventionally, such a signal is provided when a mailman lowers a flag on the mailbox which the mailbox user has raised. A conventional mailbox signal flag is disclosed in U.S. Pat. No. 4,905,891 of Wildish et al. Such a conventional flag signal has several disadvantages. First, it requires the mailbox user to remember to raise the flag. Second, it requires the mailman to remember to lower the flag. Often either the mailbox owner or the mailman forgets to carry out his part of the signalling operation.

The foregoing disadvantages are overcome by the unique movable mailbox tray and the mailbox kit of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved movable mailbox tray in which a movable tray moves on rollers for providing a rolling contact between the movable tray and the mailbox. The coefficient of rolling friction is much less than the coefficient of sliding friction, and a smooth tray movement is achieved. The movable mailbox tray can be in the form of a trolley that rides on a plurality of rollers, and the movable trolley moves easily into and out of a mailbox.

In addition, a kit for converting a conventional mailbox into one with a movable tray includes a movable trolley, a first spring for connecting the movable trolley to a hinged mailbox door, and an opposing second spring for connecting the opposite end of the trolley to a fixed wall of the mailbox. When the mailbox door is opened, the first spring will pull the trolley partially out from the interior of the mailbox. The opposing second spring will pull the trolley back into the interior of the mailbox when the door is closed. The movable trolley can also include a fence for retaining mail on the tray.

The kit can also include electrical components to provide an automatic, electric, mail-signalling device which automatically energizes a lamp providing a signal that the mailbox door has been opened.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will for the subject matter of the claims appended hereto. In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skill in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved movable mailbox tray which has all of the advantages of the prior art and none of the disadvantages.

It is another object of the present invention to provide a new and improved movable mailbox tray which may be easily and efficiently manufactured and marketed.

It is a further object of the present invention to provide a new and improved movable mailbox tray which is of durable and reliable construction.

An even further object of the present invention is to provide a new and improved movable mailbox tray which is susceptible of a low cost of manufacture with regard to both materials and labor, and which accordingly is then susceptible of low prices of sale to the consuming public, thereby making such movable mailbox tray available to the buying public.

Still yet a further object of the present invention is to provide a movable tray kit for attaching to a mailbox whereby a mailbox, not having a movable tray, is converted into a mailbox that has a movable tray.

Yet another object of the present invention is to provide a movable tray kit which includes electrical lamp signaling means for providing a light signal for indicating when the mailbox door has been opened.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 7 is side view of a movable mailbox tray installed with a kit of the invention in a mailbox shown in phantom view.

FIG. 8 is a partial, enlarged, perspective view of one end of a second spring shown in FIG. 7 taken within the circle 8 in FIG. 7.

FIG. 9 is a partial, enlarged, perspective view of one end of a first spring shown in FIG. 7 taken within the circle 9 in FIG. 7.

DESCRIPTION OF THE PREFERRED EMBODIMENT

Figure 1:
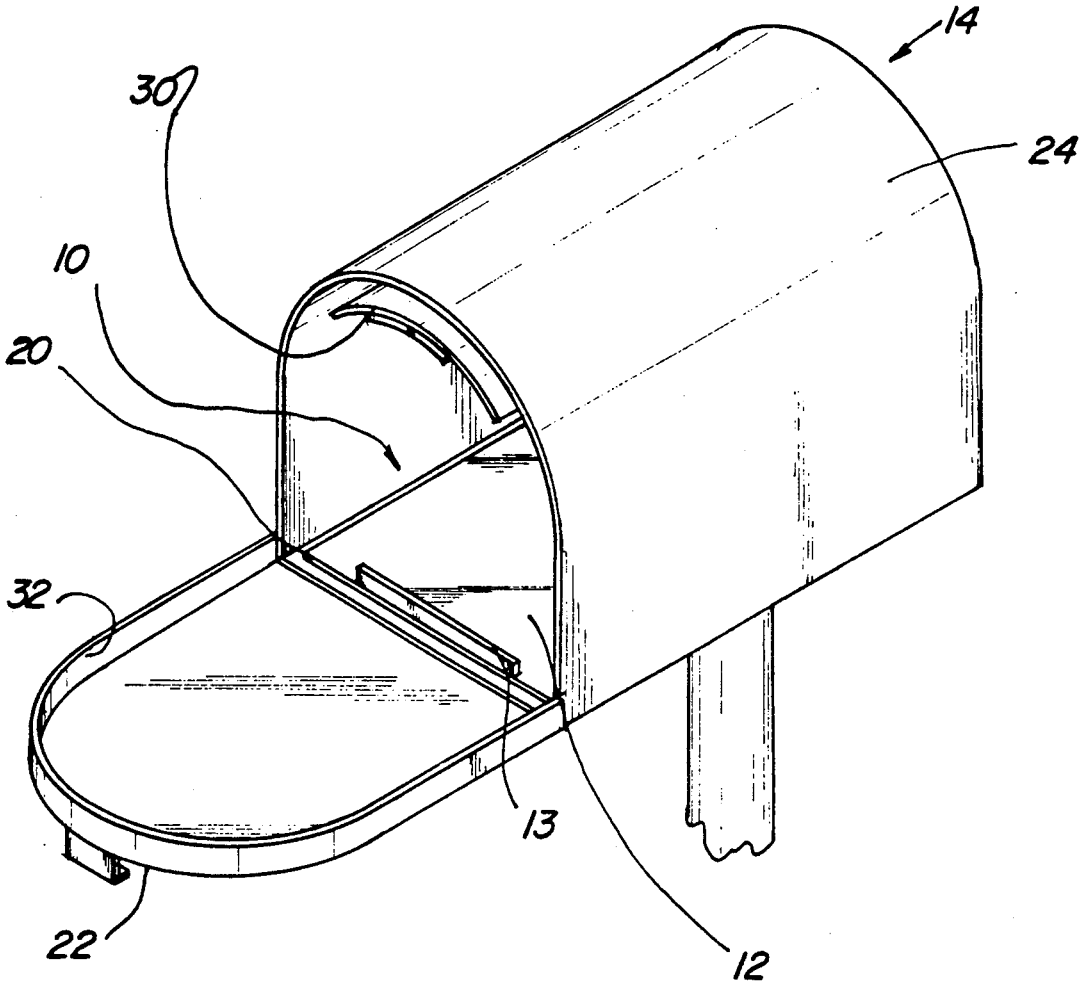
FIG. 1 is a perspective view showing a preferred embodiment of the movable mailbox tray of the invention installed in a mailbox.

With reference to the drawings, a new and improved movable mailbox tray embodying the principles and concepts of the present invention will be described.

Turning initially to FIGS. 1–4, there is shown a first exemplary embodiment of the movable mailbox tray of the invention generally designated by reference numeral 10. In its preferred form, movable mailbox tray 10 comprises a substantially horizontal tray floor 12 for receiving mail (not shown) deposited in the mailbox 14. The movable mailbox tray 10 also includes a plurality of rollers 16 which are located between the tray floor 12 and the lower housing panel 18 (see FIG. 7) of the mailbox 14. The rollers 16 provide a rolling contact between the tray floor 12 and the fixed lower housing panel 18. The rolling characteristics of the movable mailbox tray 10 of the invention are closely allied with the rolling characteristics of a trolley. Hence, the movable mailbox tray 10 of the invention may be referred to as a movable trolley 10.

More specifically, the tray floor 12 includes a forward end 20 that is located near the mailbox door 22 when the movable mailbox trolley 10 is inserted into the mailbox outer housing 24. The tray floor 12 also includes a rearward end 26 opposite to the forward end 20. The tray floor 12 further includes a fence 13, located near the forward end 20 of the tray floor 12, for retaining mail on the movable mailbox trolley 10.

The movable mailbox trolley 10 also includes a vertical tray panel 28 connected to the tray floor 12 at the rearward end 26 and a horizontal tray roof panel 30 connected to the vertical tray panel 28 and projecting from the rearward end 26 toward the forward end 20. Preferably, the tray roof panel 30 has a shape that is similar (in the geometrical sense as in "similar" triangles) to the top portion of the outer mailbox housing 24.

For economy and simplicity of manufacture, the tray floor 12, the vertical tray panel 28, and the tray roof panel 30 can be fabricated as a unitary structure from a suitable plastic stock material.

Figure 2:
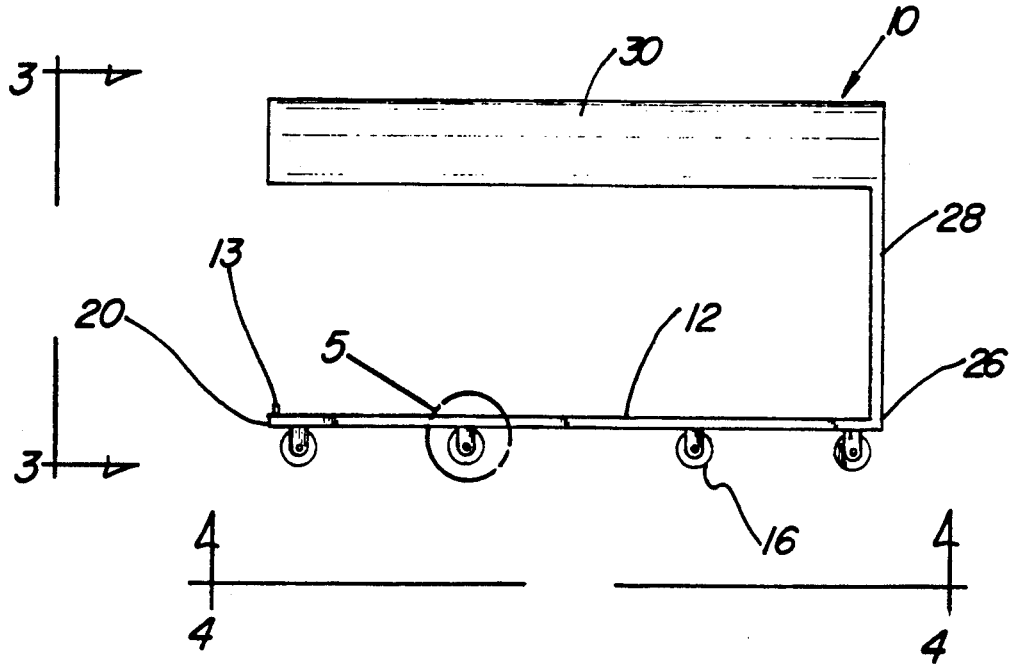
FIG. 2 is a side view of the movable mailbox tray shown in FIG. 1 removed from the mailbox.
Figure 3:
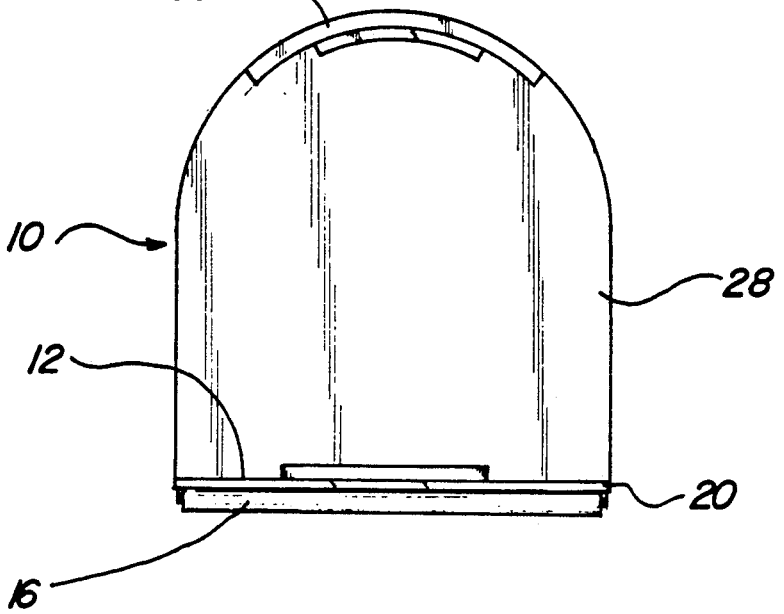
FIG. 3 is a front view of the movable mailbox tray of FIG. 2 taken along line 3—3 thereof.
Figure 4:
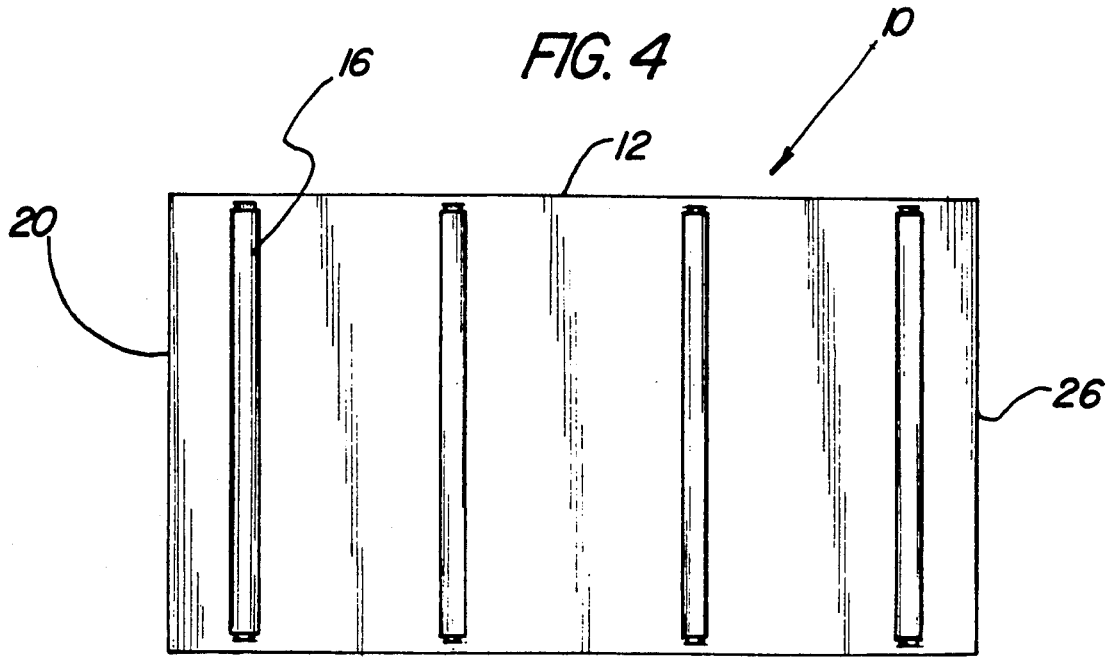
FIG. 4 is a bottom view of the movable mailbox tray shown in FIG. 2 taken along line 4—4 thereof.

In use, the embodiment of the movable mailbox trolley 10 shown in FIG. 2 is easily moved into and out of the mailbox outer housing 24 because of the rolling contact between the rollers 16 and the fixed lower mailbox housing 18 (see FIG. 7). As shown in FIG. 1, the curved shape of the inner flange 32 of the door 22 would serve to stop the movable mailbox trolley 10 from rolling out too far from the interior of the mailbox 14.

Figure 5:
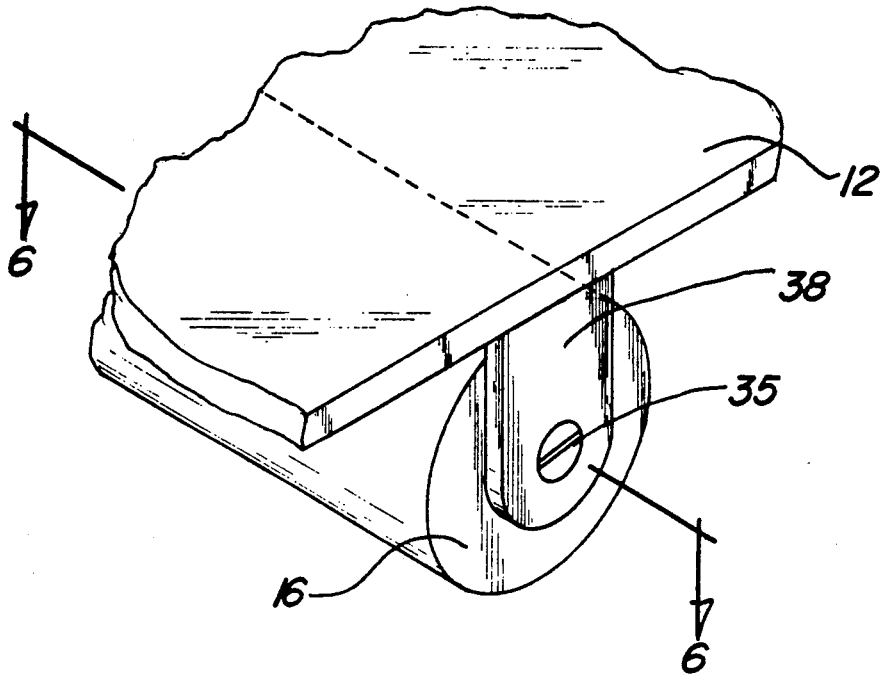
FIG. 5 is a partial, enlarged, perspective view of one end of a roller assembly shown in FIG. 2 taken within the circle 5 in FIG. 2.
Figure 6:
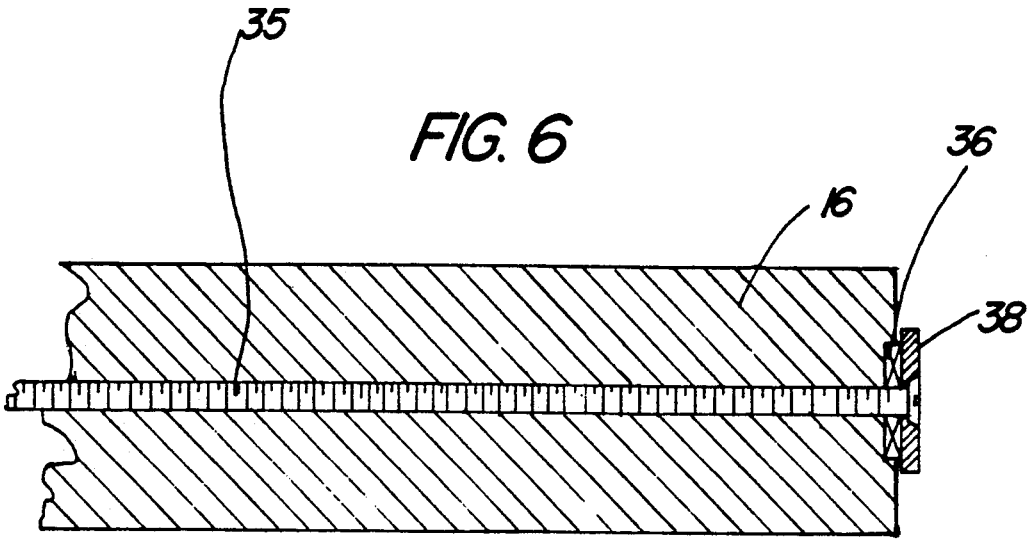
FIG. 6 is a partial cross-sectional view of the roller assembly shown in FIG. 5 taken along line 6—6 thereof.

Turning to FIGS. 5 and 6, a roller 16 is seen to be supported by a threaded rod 35 which rides on a bearing 36. The roller 16, rod 35, and bearing 36 are supported by bracket 38 which is attached to tray floor 12. It is understood that the means for rolling the movable mailbox trolley 10 can be embodied in other conventional forms such as wheels located at the sides of the tray floor 12.

Turning to FIGS. 7–10, an alternative embodiment of the invention is shown. This embodiment of the invention includes a kit for converting a conventional mailbox, that has no movable tray, into a mailbox in accordance with the invention in which a movable tray, including a rolling trolley is provided. More specifically, an embodiment of the kit of the invention includes a movable tray assembly, means for connecting the movable tray assembly to the mailbox door 22, and means for connecting the movable tray assembly to the rear vertical wall 54 of the mailbox 14.

Even more specifically, the movable tray assembly, or movable trolley 10, includes the tray floor 12 for retaining mail deposited thereon, and includes the rollers 16 located between the tray floor 12 and the lower housing panel 18 of the mailbox 14.

In addition, with the kit of the invention, a resilient first spring 40 has one end 42 connected to mailbox door 22 by suitable connecting means, such as a nut and bolt, and has the other end 44, which includes eyelet 45, connected to the tray 12 by threaded bolt 46, which passes through eyelet 45, and screws into complementary threaded hole 48 in tray 12. The door 22 is hinged at the bottom and opens by pivoting around the bottom hinges. When the door 22 is opened, such as when the mailman gets ready to put mail into the mailbox 14 and when the user get ready to remove mail from the mailbox, the first spring 40 serves to pull the movable mailbox tray 10 outward from the interior of the mailbox 14.

As the movable mailbox tray 10 is moved outward from the interior of the mailbox 14, a tension force that opposes the tension of the first resilient spring 40 on the tray 12 is exerted by the second resilient spring 51 on the tray 12. More specifically, one end 50 of the second resilient spring 51 is connected to the rear vertical wall 28, such as by a conventional retaining clip 52, and the other end of the second resilient spring 51 is connected to the rear wall 54 of the mailbox 14 by suitable conventional connecting means such as a nut and bolt.

Having been opened, as the door 22 is closed, both the return tension of the first spring 40 and the tension of the second spring 51 cause the movable mailbox tray 10 to be returned into the interior of the mailbox 14.

Figure 10:
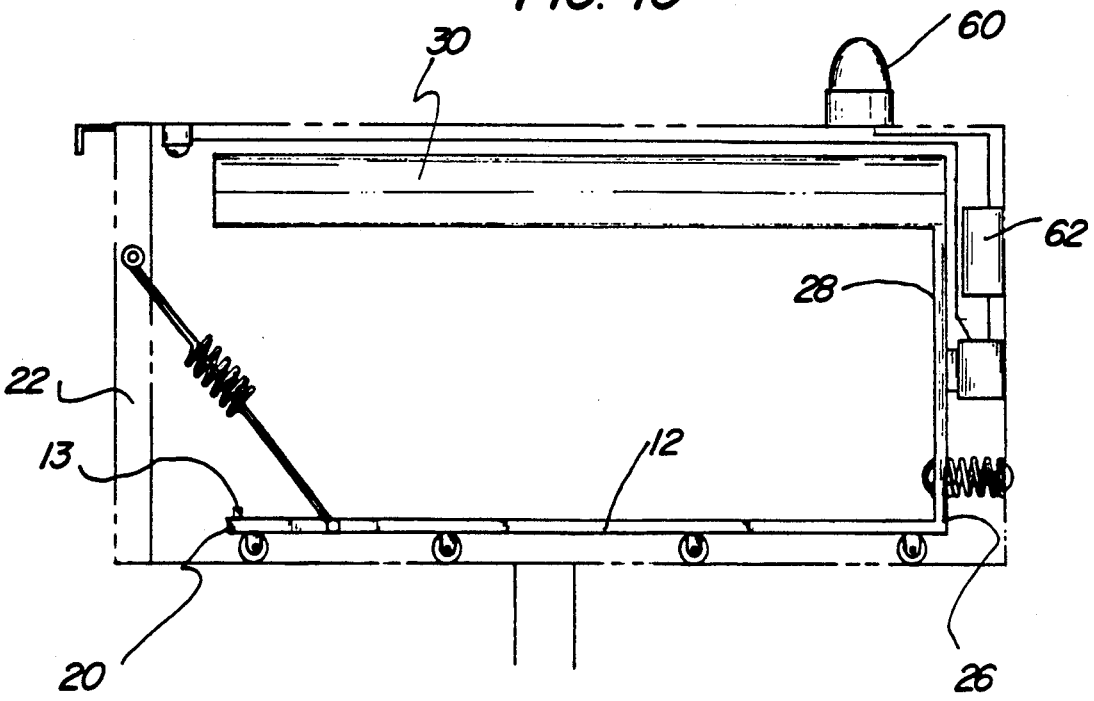
FIG. 10 is side view of a movable mailbox tray installed with a kit of the invention in a mailbox shown in phantom view as shown in FIG. 7, further including electrical compnents that provide a light signal that the mailbox door has been opened.
Figure 11:
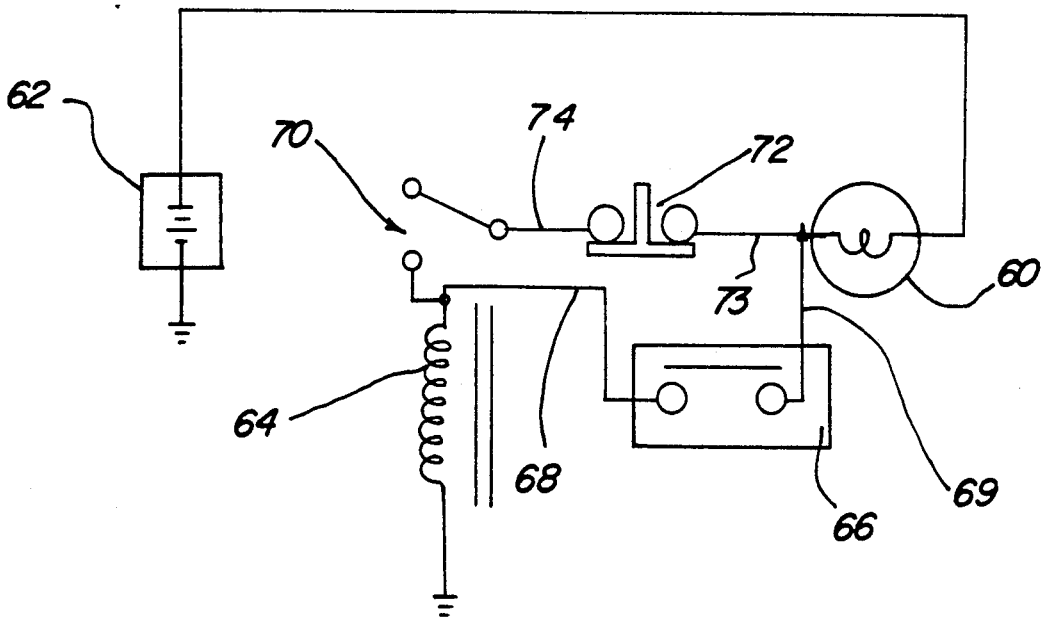
FIG. 11 is an electrical schematic diagram for the electrical circuitry employing the electrical components shown in FIG. 10.

As shown in FIGS. 10 and 11, another embodiment of the kit of the invention is provided that includes means for using an electrical lamp to provide a visible signal indicating when the mailbox 14 door 22 has been opened.

More specifically, the means for electrical signaling include conductors and components that form a main series circuit and two parallel branch circuits within the main series circuit. The two parallel branch circuits are designated as a first branch and a second branch.

The main series circuit includes a lamp 60, a battery 62, a relay coil 64, and electrical conductors for connecting the lamp 60, the battery 62, and the relay coil 64 together. It is noted that for a metal mailbox 14 the metal body of the mailbox can serve as a ground connection for the main series circuit. The first branch, connected between the relay coil 64 and the lamp 60, includes a tray-controlled switch 66 and electrical conductors 68 and 69 for connecting the tray-controlled switch 66 to the relay coil 64 and the lamp 60, respectively. The tray-controlled switch 66 has a first switch position (shown in FIG. 11) when the tray assembly 10 is completely inside the mailbox outer housing and has a second switch position when the tray assembly 10 is moved toward the mailbox door 22. The tray-controlled switch 66 can be a magnetic-responsive switch when the rear wall of the mailbox is comprised of a ferrous, or other magnetic, material.

The second branch, connected between the relay coil 64 and the lamp 60, includes a relay-controlled switch 70, a reset switch 72, and electrical conductors 73 and 74 for connecting the lamp 60 to the reset switch 72 and the reset switch 72 to the relay-controlled switch 70, respectively. The relay-controlled switch 70 has a first switch position when the relay coil is deenergized (shown in FIG. 11) and has a second switch position when the relay coil 64 is energized. The reset switch 72 has a first switch position for maintaining second branch circuit continuity (shown in FIG. 11) and a second switch position for breaking second branch circuit continuity. The tray-controlled switch 66, the relay coil 64, and the relay-controlled switch 70 can be a unified structure.

In operation, when the tray-controlled switch 66 is moved from its first switch position (shown in FIG. 11) to its second switch position by movement of the tray assembly 10 toward the mailbox door 22, the tray-controlled switch 66 is closed, the first branch has electrical continuity, and the relay coil 64 is energized thereby causing the relay-controlled switch 70 to move from its first switch position (shown in FIG. 11) to its second switch position, which is a closed switch position, whereby the second branch has electrical continuity, and whereby the lamp 60 is turned on, providing a continuous light signal that the mailbox door 22 had been opened. When the reset switch 72 is switched from its first switch position (shown in FIG. 11) to its second switch position, electrical continuity in the second branch is broken, the relay coil 64 is deenergized, the relay-controlled switch 70 moves from its closed second switch position to its open first switch position (shown in FIG. 11), and the lamp 60 is turned off. In this way, the light signal can be turned off when the mail is collected by the mailbox user.

It is apparent from the above that the present invention accomplishes all of the objects set forth by providing a new and improved movable mailbox tray that is low in cost, relatively simple in design and operation, and which may advantageously be used in the manner described above.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A movable tray kit for attaching to a mailbox, wherein the mailbox includes a door and an outer housing, and wherein the outer housing includes a substantially horizontal, fixed lower housing panel, and also includes a rear vertical wall, said kit, comprising:

a movable tray assembly which includes, a tray floor for retaining mail deposited thereon, and roller means, located between said tray floor and the lower housing panel of the mailbox, for providing a rolling contact between said tray floor and the fixed lower housing panel;

means for connecting said movable tray assembly to the mailbox door; and means for connecting said movable tray assembly to the rear vertical wall of the mailbox, wherein said mailbox further includes a first roof panel extending from said mailbox rear wall toward said mailbox door, said first roof panel being spaced a predetermined distance above said floor of said movable tray assembly, and wherein said tray assembly has a second roof panel extending toward said mailbox door above said tray assembly floor and below said first mailbox roof panel such that said second roof panel provides a protective top substantially covering the floor of said tray assembly when said tray assembly is caused to roll on said fixed lower housing panel.

2. The kit described in claim 1 wherein:

said means for connecting said movable tray assembly to the mailbox door includes a resilient first spring and means for connecting said first spring to the door and to said tray floor; and said means for connecting said movable tray assembly to the rear vertical wall of the mailbox includes a resilient second spring and means for connecting said second spring to the rear vertical wall of the mailbox.

3. A movable tray kit for attaching to a mailbox, wherein the mailbox includes a door and an outer housing, and wherein the outer housing includes a substantially horizontal, fixed lower housing panel, and also includes a rear vertical wall, said kit, comprising:

a movable tray assembly which includes, a tray floor for retaining mail deposited thereon, and roller means, located between said tray floor and the lower housing panel of the mailbox, for providing a rolling contact between said tray floor and the fixed lower housing panel;

means for connecting said movable tray assembly to the mailbox door; and means for connecting said movable tray assembly to the rear vertical wall of the mailbox;

further including electrical lamp signaling means for providing a light signal for indicating when the mailbox door has been opened, and wherein said electrical lamp signaling means includes a tray-controlled switch.

4. The kit described in claim 3 wherein:

said electrical lamp signaling means includes means for forming an electrical circuit which includes a main series circuit and two parallel branch circuits within the main series circuit, the two parallel branch circuits being designated as a first branch and a second branch;

said main means for forming said series circuit includes a lamp, a source of electric power, a relay coil, and electrical conductors for connecting said lamp, said source of electric power, and said relay coil together;

said first branch, connected between said relay coil and said lamp, includes a tray-controlled switch and electrical conductors for connecting said tray-controlled switch to said relay coil and said lamp, said tray-controlled switch having a first switch position when said tray assembly is completely inside the mailbox outer housing and having a second switch position when said tray assembly is moved toward the mailbox door;

said second branch, connected between said relay coil and said lamp, includes a relay-controlled switch, a reset switch, and electrical conductors for connecting said lamp to said reset switch and said reset switch to said relay-controlled switch, said relay-controlled switch having a first switch position when said relay coil is deenergized and having a second switch position when said relay coil is energized, said reset switch having a first switch position for maintaining second branch circuit continuity and a second switch position for breaking second branch circuit continuity.

5. The kit described in claim 4 wherein in operation, when said tray-controlled switch moves from its first switch position to its second switch position by movement of the said tray assembly toward the mailbox door, the first branch has electrical continuity, and said relay coil is energized thereby causing said relay-controlled switch to move from its first switch position to its second switch position, whereby the second branch has electrical continuity, and whereby said lamp is turned on, providing a continuous light signal that the mailbox door had been opened; and when said reset switch is switched from its first switch position to its second switch position, electrical continuity in said second branch is broken, said relay coil is deenergized, said relay-controlled switch moves from its second switch position to its first switch position, and the lamp is turned off.

* * * * *